United States Patent [19]

Rischar

[11] 3,985,387

[45] Oct. 12, 1976

[54] BACK PACK CHAIR

[76] Inventor: Bernard J. Rischar, 2829 College Ave., Quincy, Ill. 62301

[22] Filed: May 2, 1975

[21] Appl. No.: 573,950

[52] U.S. Cl. ..... 297/4; 297/16

[51] Int. Cl.[2] ..... A47C 9/10

[58] Field of Search ..... 297/4, 34, 51, 52, 292, 297/16; 248/155, 155.4

[56] References Cited

UNITED STATES PATENTS

| | | | |
|---|---|---|---|
| 279,398 | 6/1883 | Knapp | 297/34 |
| 359,921 | 3/1887 | Cowan | 297/4 |
| 376,886 | 1/1888 | Holden | 297/292 |
| 690,122 | 12/1901 | Slagle | 297/4 |
| 699,932 | 5/1902 | Smith | 297/4 |
| 1,244,911 | 10/1917 | Smith | 297/34 |
| 2,099,345 | 11/1937 | Olszanowski | 297/4 |

*Primary Examiner*—Roy D. Frazier
*Assistant Examiner*—William E. Lyddane
*Attorney, Agent, or Firm*—Hume, Clement, Brinks, Willian, Olds & Cook, Ltd.

[57] ABSTRACT

A collapsible back pack chair adapted to be carried on the back of a user. The chair comprises a frame having a seat pivotally attached to its bottom edge. The seat has an elongated leg mounted on its bottom surface which forms a unit therewith. In use, the frame is attached to the back of the user through utilization of straps or the like. When the frame is so attached to the back of the user, the seat and leg may be pivoted as a unit from a stored position in which the leg is upright, adjacent to the frame, to an open position in which the free end of the leg is brought into contact with the ground, thereby providing support for the seat which will be located beneath the user in a position for sitting thereon.

6 Claims, 5 Drawing Figures

BACK PACK CHAIR

INTRODUCTION

The present invention relates generally to a collapsible chair and, more particularly, to a collapsible back pack chair adapted to be carried on the back of a user.

BACKGROUND OF THE INVENTION

Although collapsible seating devices designed for the use of campers, hunters, sportsmen and other outdoor recreational users are commercially available, it has been found that they are too bulky and clumsy to carry in many situations.

The present invention is a relatively simple, light-weight device which is designed to be conveniently carried on the back of the user. Furthermore, the unique design of the device allows it to be utilized for seating purposes without the necessity of removing it from the back of the user.

BRIEF DESCRIPTION OF THE INVENTION

In accordance with the present invention, a frame is provided having a seat pivotally attached to its bottom edge. The seat has an elongated leg mounted on its bottom surface which forms a unit therewith. In use, the frame is attached to the back of the user through utilization of straps or the like. When the frame is so attached to the back of the user, the seat and leg may be pivoted as a unit from a stored position in which the leg is upright, adjacent to the frame, to an open position in which the free end of the leg is brought into contact with the ground, thereby providing support for the seat which will be located beneath the user in a position for sitting thereon.

DESCRIPTION OF THE PREFERRED EMBODIMENT

Figure 1:
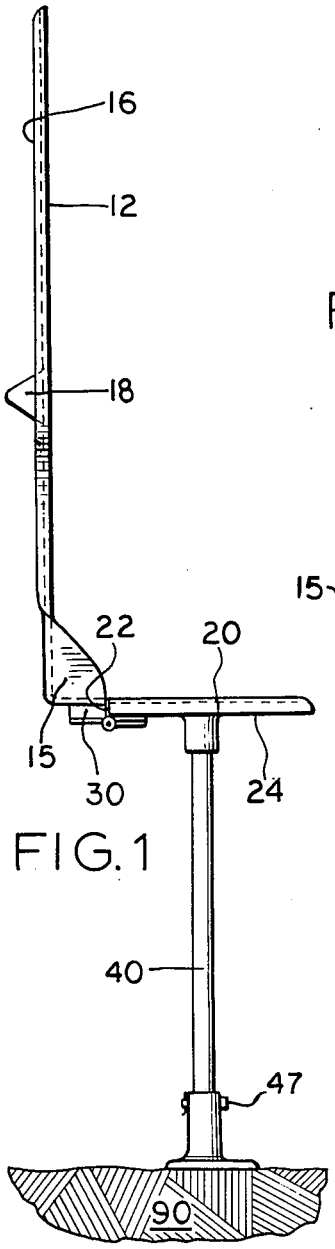
FIG. 1 is a side elevational view of a collapsible back pack chair constructed in accordance with an embodiment of the present invention.
Figure 2:
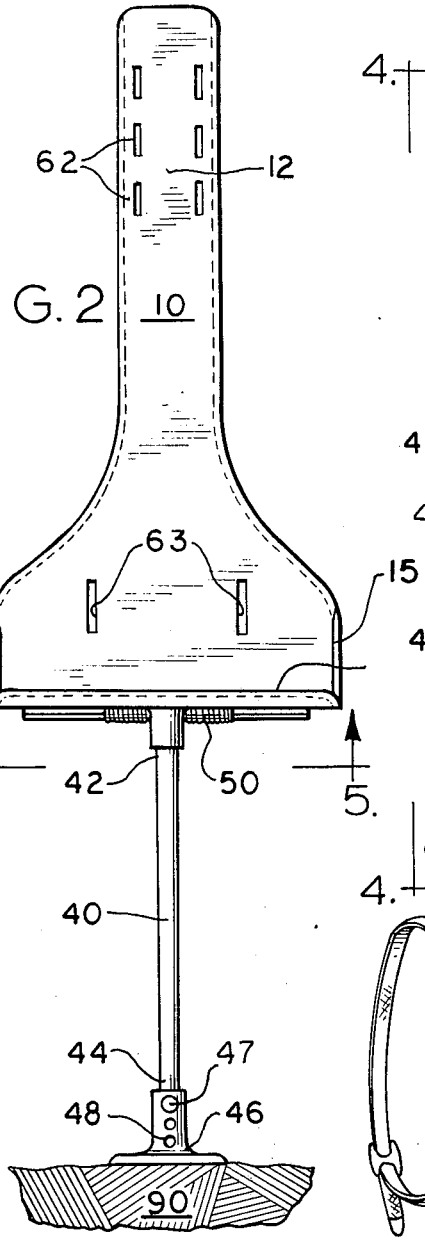
FIG. 2 is a front elevational view of the device shown in FIG. 1.

Referring initially to FIGS. 1 and 2, in the preferred embodiment of the invention, a frame 10 is provided which has a front surface 12 constructed in a manner so as to conform comfortably to the back of a user. A seat 20 is pivotally attached along its side edge 22 to the bottom edge 14 of the frame by means of a pair of hinges 30. An adjustable leg 40 is mounted at its end 42 to the bottom surface 24 of seat 20. In order to facilitate carrying of the back pack chair, the frame 10, seat 20 and leg 40 may be constructed of light-weight materials, such as fiberglass.

Figure 3:
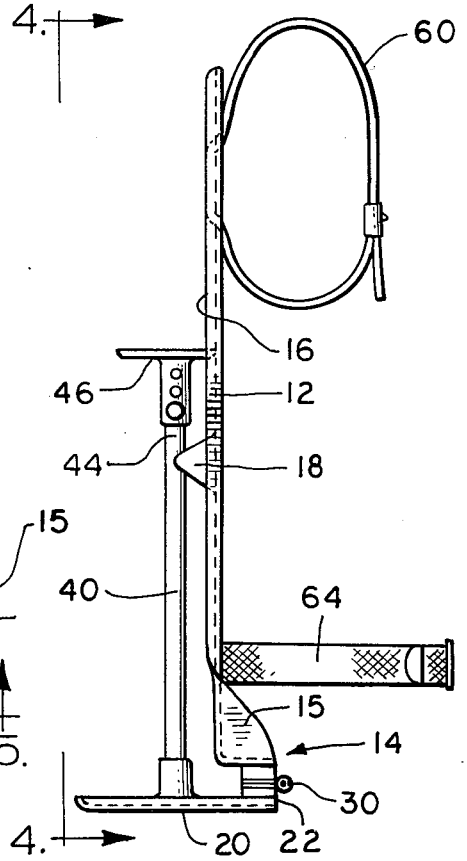
FIG. 3 is a side elevational view similar to FIG. 1, but showing carrying straps mounted on the device and the leg of the device in upright, stored position.
Figure 4:
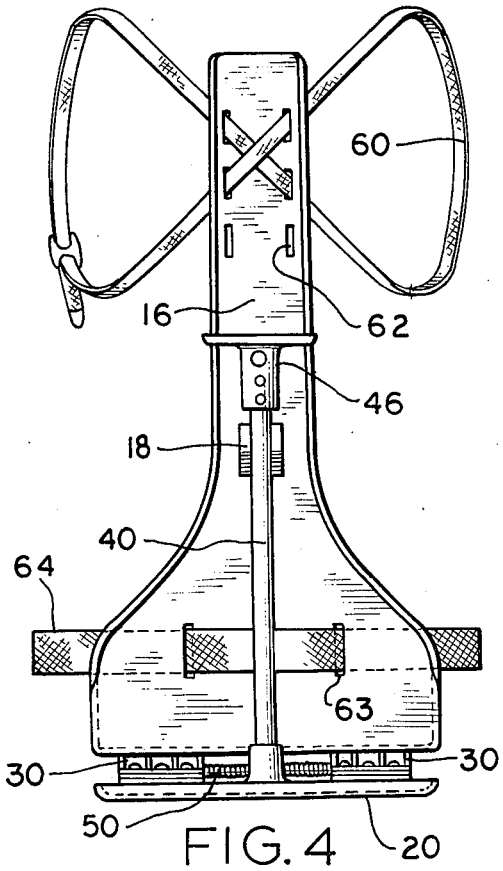
FIG. 4 is a back elevational view of the device shown in FIG. 3.

Referring now to FIGS. 3 and 4, leg 40 and seat 20 are shown pivoted to a stored position where the free end 44 of leg 40 is adjacent to back surface 16 of frame 10. The leg and seat are held in this stored position by means of a torsion spring 50.

Figure 5:
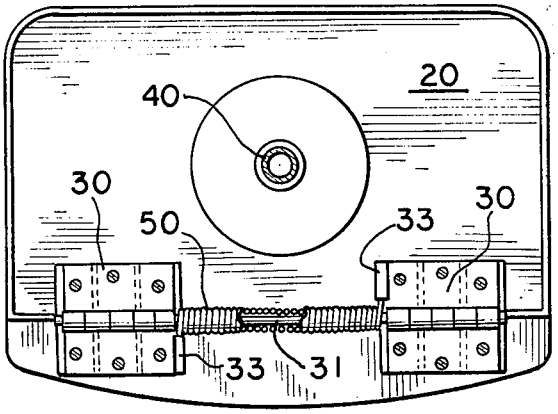
FIG. 5 is a bottom view in section of the device taken along line 5—5 of FIG. 2.

As is clearly illustrated in FIG. 5, the two hinges 30 and the torsion spring 50 are all mounted on a single hinge pin 31. In addition each free end of the torsion spring 50 is removably anchored to its adjacent hinge by means of anchoring tubes 33. This structural arrangement also allows for the simple and expeditious replacement of the torsion spring 50 should it be damaged in any way. Of course, the hinge pin 31 is held in place by any suitable securement means as, for example, cotter pins or the like.

In operation, the torsion spring 50 urges leg 40 and seat 20 to pivot to the stored position in which the leg 20 rests against a support 18 mounted on the back surface 16 of frame 10.

Also illustrated in FIGS. 3 and 4 is a means mounted on said frame for attaching it to the back of the user. In the preferred embodiment, the attaching means is a shoulder strap harness 60 of conventional design which is mounted on frame 10 by passing it through slots 62 formed therein. A number of slots are formed in the frame in order to provide a range of vertical adjustment so as to meet the requirements of users of various physical builds. A waist belt 64 is also attached to slots 63 in the frame and provides additional stability for the device when carried on the back of the user.

In accordance with a preferred embodiment of the present invention, and as is illustrated in FIGS. 1 and 3, the frame 10 also includes, at its bottom edge 14, a short substantially perpendicular flange 15 which enables the leg 40 to be positioned centrally on seat 20 and still in close proximity to frame 10 when the seat 20 and leg 40 are in the stored position.

In use, the arms of the user are inserted through the loops formed by shoulder strap harness 60 and waist belt 64 is secured about the user. Torsion spring 50 normally retains the seat unit in a stored position against frame 10 in which it is out of the way of the user as is illustrated in FIGS. 3 and 4.

When desiring to be seated, the user simply reaches behind his back with one hand and pivots the leg and seat downward against the bias of torsion spring 50 so that the free end 44 of leg 40 is positioned on the ground 90 and attached seat 20 is located beneath the user as is illustrated in FIGS. 1 and 2. When the user rises from the seat, the leg and seat automatically pivot back up into the stored position due to the action of torsion spring 50. In this manner, the entire operation may be accomplished without the necessity of removing the device from the back of the user.

As was noted above, harness 60 may be vertically adjusted along frame 10 by selection of the appropriate slots 62 so as to properly locate seat 20 beneath users of various physical builds. Likewise, the distance between seat 20 and the ground 90 may be varied to match the length of the particular user's legs by adjusting the length of leg 40. This is accomplished by means of sliding the free end 44 of leg 40 within base 46 and securing it at the proper height by placing pin 47 through one of the holes 48 formed in the base. When so inserted, the pin engages a similar hole (not shown) formed in the free end of leg 40 thereby locking it into position. Of course, other means for adjusting the height of leg 40 may be employed. For example, the base 46 and the free end 44 of leg 40 may be provided with mating threaded surfaces such that simple rotation of the base 46 will result in its longitudinal displacement on leg 40.

While a particular embodiment of the present invention has been shown and described, it should be understood that various changes and modification thereto may be made, and it is therefore intended in the following claims to include all such modifications and changes as may fall within the true spirit and scope of this invention.

What is claimed is:

1. A collapsible back pack chair adapted to be carried on the back of a user, said chair comprising:

a frame adapted for attachment to the back of a user and having a bottom edge;

a seat having one edge including a pivotal member in cooperation with the bottom edge of said frame;

a leg extending from the bottom of said seat;

means associated with said pivotal member for automatically folding said seat and leg from an open to a stored position when said user releases his weight from the open chair, said leg extending upwardly and adjacent to said frame when said chair is in said stored position; and means for attaching said chair to the user comprising waist and shoulder straps operably connected to said frame.

2. The back pack chair of claim 1 where the bottom edge of said frame comprises a forwardly extending flange disposed perpendicular to said frame, and said seat and said leg fold 180° to said stored position whereby said leg is adjacent the back surface of said frame.

3. The back pack chair of claim 1 wherein said folding means is adapted to hold said seat and said leg in said stored position.

4. The back pack chair of claim 1 wherein said folding means comprises a torsion spring mounted on said pivotal member.

5. The back pack chair of claim 1 including means for adjusting the length of said leg.

6. The back pack chair of claim 1 including means for vertically adjusting said attaching means on said frame.

* * * * *